US011122363B2

(12) United States Patent
Tsutsumi et al.

(10) Patent No.: US 11,122,363 B2
(45) Date of Patent: Sep. 14, 2021

(54) ACOUSTIC SIGNAL PROCESSING DEVICE, ACOUSTIC SIGNAL PROCESSING METHOD, AND ACOUSTIC SIGNAL PROCESSING PROGRAM

(71) Applicant: Nippon Telegraph and Telephone Corporation, Tokyo (JP)

(72) Inventors: Kimitaka Tsutsumi, Musashino (JP); Kenichi Noguchi, Musashino (JP); Hideaki Takada, Musashino (JP); Yoichi Haneda, Musashino (JP)

(73) Assignee: Nippon Telegraph and Telephone Corporation, Tokyo (JP)

( * ) Notice: Subject to any disclaimer, the term of this patent is extended or adjusted under 35 U.S.C. 154(b) by 0 days.

(21) Appl. No.: 16/977,002

(22) PCT Filed: Feb. 28, 2019

(86) PCT No.: PCT/JP2019/007754
§ 371 (c)(1),
(2) Date: Aug. 31, 2020

(87) PCT Pub. No.: WO2019/168083
PCT Pub. Date: Sep. 6, 2019

(65) Prior Publication Data

US 2021/0006892 A1 Jan. 7, 2021

(30) Foreign Application Priority Data

Mar. 1, 2018 (JP) ..... JP2018-036186

(51) Int. Cl.
*H04R 1/40* (2006.01)
*H04R 3/12* (2006.01)

(52) U.S. Cl.
CPC ..... *H04R 1/403* (2013.01); *H04R 3/12* (2013.01); *H04R 2499/13* (2013.01)

(58) Field of Classification Search
None
See application file for complete search history.

(56) References Cited

FOREIGN PATENT DOCUMENTS

JP 2011-244306 12/2011
JP 2012169895 A * 9/2012

OTHER PUBLICATIONS

Haneda, Yoichi, et al. "Design of Multipole Loudspeaker Array Based on Spherical Harmonic Expansion." ICASSP 2011, 2011, pp. 141-144. (Year: 2011).*

(Continued)

*Primary Examiner* — James K Mooney
(74) *Attorney, Agent, or Firm* — Fish & Richardson P.C.

(57) ABSTRACT

An acoustic signal processing device 1 includes: a focal point position determination unit 12 that obtains a plurality of sets of initial focal point coordinates, coordinates of the virtual sound source, and a direction of directivity thereof, and for a pair of sets of initial focal point coordinates with different polarities among the plurality of sets of initial focal point coordinates, multiplies the sets of initial focal point coordinates by a rotation matrix based on the coordinates of the virtual sound source to thereby determine sets of focal point coordinates, the rotation matrix being specified from the direction of the directivity; a circular harmonic coefficient conversion unit 13 that calculates weights to be applied to multipoles including the sets of focal point coordinates from a circular harmonic coefficient; a filter coefficient computation unit 14 that, for each of the speakers in the speaker array, computes a weighted driving function to be applied to the speaker from the sets of focal point coordinates, polarities of the sets of focal point coordinates, and the weights to be applied to the multipoles; and a convolutional operation unit 15 that, for each of the speakers in the speaker array, convolves the weighted driving function for the (Continued)

speaker into the input acoustic signal to output the output acoustic signal for the speaker.

11 Claims, 9 Drawing Sheets

(56) References Cited

OTHER PUBLICATIONS

Choi, Jung-Woo, and Yang-Hahn Kim. "Sound Field Reproduction of a Virtual Source Inside a Loudspeaker Array with Minimal External Radiation." IEEE, vol. 21, No. 2, Feb. 2013, pp. 247-259. (Year: 2013).*

Ahrens et al., "Implementation of Directional Sources in Wave Field Synthesis," 2007 IEEE Workshop on Application of Signal Processing to Audio and Acoustics, Oct. 2007, pp. 66-69.

Haneda et al., "Directivity Synthesis Using Multipole Sources Based on Spherical Harmonic Expansion," The Journal of the Acoustical Society of Japan, Nov. 2013, 69(11):577-588, English Abstract.

Spors et al., "Physical and Perceptual Properties of Focused Sources in Wave Field Synthesis," Audio Engineering Society: Convention Paper, Oct. 2009, 19 pages.

Tsutsumi et al., "Directivity Synthesis with Multipoles Comprising a Cluster of Focused Sources Using a Linear Loudspeaker Array," IEEE International Conference on Acoustics, Speech and Signal Processing, Apr. 2018, pp. 496-500.

* cited by examiner

FIG. 4

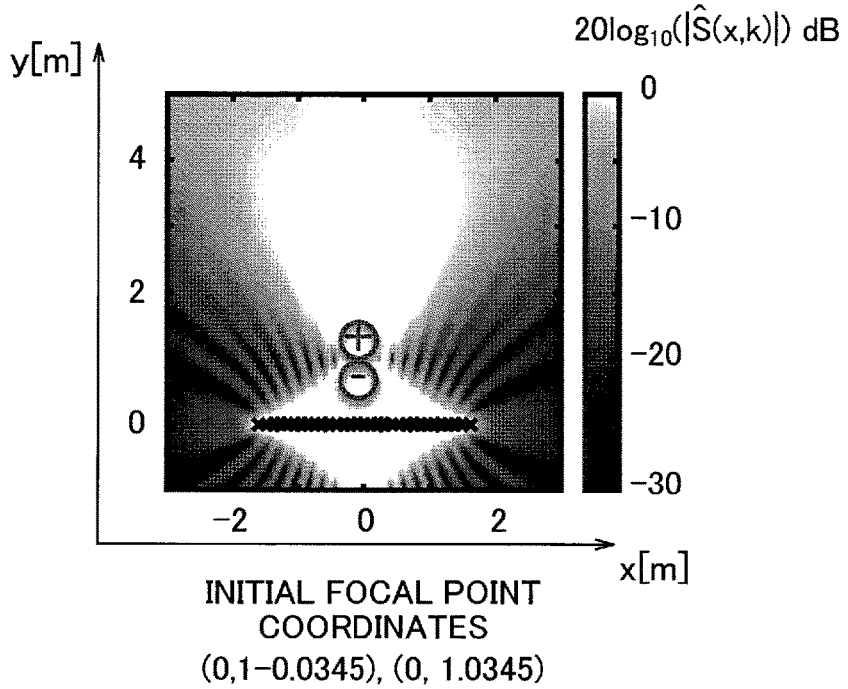

FIG. 5

$$\begin{pmatrix} 0.0172 \\ 1.0299 \end{pmatrix} = \underbrace{\begin{pmatrix} \cos\left(-\frac{\pi}{6}\right) & -\sin\left(-\frac{\pi}{6}\right) \\ \sin\left(-\frac{\pi}{6}\right) & \cos\left(-\frac{\pi}{6}\right) \end{pmatrix}}_{\text{ROTATION MATRIX}} \underbrace{\begin{pmatrix} 0.0 \\ 0.0345 \end{pmatrix}}_{\text{FOCAL POINT SOUND SOURCE}} + \underbrace{\begin{pmatrix} 0.0 \\ 1.0 \end{pmatrix}}_{\text{VIRTUAL SOUND SOURCE}}$$

ACOUSTIC SIGNAL PROCESSING DEVICE, ACOUSTIC SIGNAL PROCESSING METHOD, AND ACOUSTIC SIGNAL PROCESSING PROGRAM

CROSS-REFERENCE TO RELATED APPLICATIONS

This application is a National Stage application under 35 U.S.C. § 371 of International Application No. PCT/JP2019/007754, having an International Filing Date of Feb. 28, 2019, which claims priority to Japanese Application Serial No. 2018-036186, filed on Mar. 1, 2018. The disclosure of the prior application is considered part of the disclosure of this application, and is incorporated in its entirety into this application.

TECHNICAL FIELD

The present invention relates to an acoustic signal processing device, an acoustic signal processing method, and an acoustic signal processing program for converting an input acoustic signal into output acoustic signals for a plurality of speakers in a speaker array formed by arranging the speakers for creating a virtual sound source.

BACKGROUND ART

In public viewings and concerts, voice, music, and the like are reproduced from a plurality of speakers installed at the screening site. In recent years, efforts have been made to implement acoustic reproduction with a more live feeling than ever by creating a virtual sound source in the screening space. For example, a high live feeling is achieved in particular by using a speaker array formed by linearly arranging a number of speakers to generate a virtual sound source that protrudes forward of the speakers and is closer to the audience.

Also, generally, the power of sound or voice emitted from a musical instrument or a human body differs from one direction to another. Thus, by reproducing the direction-specific difference (directivity) in the power of an acoustic signal when a virtual sound source is generated in a screening space, an acoustic content with an even higher live feeling can be expected to be created.

There is a technique called wave field reconstruction (Patent document 1) as opposed to the acoustic reproduction technique that creates a virtual sound source in a screening space. In the method based on Patent document 1, acoustic signals at an acoustic signal recording point are recorded with microphones installed at a plurality of points. Then, the incoming directions of the top, bottom, left, and right acoustic signals are analyzed, and a plurality of speakers installed in the screening space are used to physically reconstruct the acoustic signals in the recording site.

There is a technique which assumes a suction-type sound source (acoustic sink) as a virtual sound source to be implemented, and applies a drive signal derived from the first Rayleigh integral to a speaker array to generate a virtual sound image forward the speakers (Non-patent document 1). There is also a technique that can implement primitive directivity such as a dipole with a virtual sound source to be generated in a screening space using a linear speaker array (Non-patent document 2).

There is a multipole sound source as means for controlling the directivity of sound emitted from speakers (Non-patent document 3). A multipole sound source is means for expressing the directivity of sound with a combination of primitive directivities such as a dipole or a quadrupole, and each primitive directivity is implemented by combining non-directional point sound sources (monopole sound sources) that are close in distance to each other and have different polarities. Non-patent document 3 discloses that primitive directivities with different intensities are superimposed to rotate the direction of directivity.

PRIOR ART DOCUMENTS

Patent Document

Patent document 1: Japanese Patent Application Publication No. 2011-244306

Non-Patent Documents

Non-patent document 1: Sascha Spors, Hagen Wierstorf, Matthias Gainer, and Jens Ahrens, "Physical and Perceptual Properties of Focused Sources in Wave Field Synthesis," in 127th Audio Engineering Society Convention paper 7914, 2009, October.

Non-patent document 2: J. Ahrens, and S. Spors, "Implementation of Directional Sources in Wave Field Synthesis," Proceeding of IEEE Workshop on Applications of Signal Processing to Audio and Acoustics, pp. 66-69, 2007.

Non-patent document 3: Yoichi Haneda, Kenichi Furuya, Suehiro Shimauchi, "Directivity Synthesis Using Multipole Sources Based on Spherical Harmonic Expansion", The Journal of Acoustical Society of Japan Vol. 69, No. 11, pp 577-588, 2013.

SUMMARY OF THE INVENTION

Problem to be Solved by the Invention

However, none of the documents mentions a technique to implement any directional characteristics via superposition of multipoles. Hence, with any of the documents, it is difficult to model the directivity of a sound source such as a musical instrument by using multipoles.

It is therefore an objective of the present invention to provide an acoustic signal processing device, an acoustic signal processing method, and an acoustic signal processing program that implement any directional characteristics by superimposing multipoles.

Means for Solving the Problem

In order to solve the above problems, a first aspect of the present invention is related to an acoustic signal processing device for converting an input acoustic signal into output acoustic signals for a plurality of speakers in a speaker array formed by arranging the speakers for creating a virtual sound source. The first aspect of the present invention includes a focal point position determination unit that obtains a plurality of sets of initial focal point coordinates, coordinates of the virtual sound source, and a direction of directivity thereof, and for a pair of sets of initial focal point coordinates with different polarities among the plurality of sets of initial focal point coordinates, multiplies the sets of initial focal point coordinates by a rotation matrix based on the coordinates of the virtual sound source to thereby determine sets of focal point coordinates, the rotation matrix being specified from the direction of the directivity, a circular harmonic coefficient conversion unit that calculates weights to be applied to multipoles including the sets of focal point coordinates from a circular harmonic coefficient, a filter coefficient computation unit that, for each of the speakers in the speaker array, computes a weighted driving function to be applied to the speaker from the sets of focal point coordinates, polarities of the sets of focal point coordinates, and the weights to be applied to the multipoles, and a convolutional operation unit that, for each of the speakers in the speaker array, convolves the weighted driving function for the speaker into the input acoustic signal to output the output acoustic signal for the speaker.

The circular harmonic coefficient conversion unit may calculate the weight to be applied to the multipole with equation (1).

[Math. 1]

[Math. 1]

$$d_{m,n} = \frac{\partial^{m+n} S(0)}{\partial x^m y^n} = j^n \cdot (m+n)! \cdot \left\{ \check{S}^{(2)}(m+n) \cdot H^{(2)}_{m+n} + (-1)^n \cdot \check{S}^{(2)}(-m-n) \cdot H^{(2)}_{-m-n} \right\}, \quad \text{equation (1)}$$

where $d_{m,n}$: the weight to be applied to a multipole $p_{m,n}$, m,n: orders of partial differentiations of an acoustic field in an x-axis direction and a y-axis direction, $\check{S}^{(2)}(m+n)$: the circular harmonic coefficient, $H_{m+n}^{(2)}(k)$: a Hankel function of a second kind of (m+n)-th order, and k: a wavenumber ($k=\omega/c$).

The filter coefficient computation unit may calculate driving functions by respectively using the sets of focal point coordinates and compute the weighted driving function to be applied to the speaker from composite driving functions calculated respectively for the multipoles and the weights to be applied to the multipoles, the composite driving functions being calculated from the polarities of the sets of focal point coordinates forming the multipoles and the driving functions.

The filter coefficient computation unit may calculate each of the composite driving functions for the multipoles by adding together functions which are obtained respectively for the sets of focal point coordinates included in the multipole and in each of which the polarity of the set of focal point coordinates and the corresponding driving function are multiplied.

The filter coefficient computation unit may calculate the weighted driving function by multiplying the composite driving functions calculated for the multipoles by the weights to be applied to the multipoles and adding the multiplied composite driving functions together.

A second aspect of the present invention is related to an acoustic signal processing method for converting an input acoustic signal into output acoustic signals for a plurality of speakers in a speaker array formed by arraying the speakers for creating a virtual sound source. The second aspect of the present invention includes obtaining a plurality of sets of initial focal point coordinates, coordinates of the virtual sound source, and a direction of directivity thereof, for a pair of sets of initial focal point coordinates with different polarities among the plurality of sets of initial focal point coordinates, multiplying the sets of initial focal point coordinates by a rotation matrix based on the coordinates of the virtual sound source to thereby determine sets of focal point coordinates, the rotation matrix being specified from the direction of the directivity, calculating weights to be applied to multipoles including the sets of focal point coordinates from a circular harmonic coefficient, for each of the speakers in the speaker array, computing a weighted drive function to be applied to the speaker from the sets of focal point coordinates, polarities of the sets of focal point coordinates, and the weights to be applied to the multipoles, and for each of the speakers in the speaker array, convolving the weighted drive function for the speaker into the input acoustic signal to output the output acoustic signal for the speaker.

A third aspect of the present invention is related to a non-transitory computer readable medium having stored thereon an acoustic signal processing program that causes a computer to function as the acoustic signal processing device according to the first aspect.

Effect of the Invention

According to the present invention, it is possible to provide an acoustic signal processing device, an acoustic signal processing method, and an acoustic signal processing program that implement any directional characteristics by superimposing multipoles.

BRIEF DESCRIPTION OF THE DRAWINGS

FIG. 4 is a diagram explaining sets of initial focal point coordinates in the focal point position determination process by the acoustic signal processing device according to the embodiment of the present invention.

FIG. 5 is a diagram explaining an example of a rotation material used in the focal point position determination process by the acoustic signal processing device according to the embodiment of the present invention.

MODES FOR CARRYING OUT THE INVENTION

Next, an embodiment of the present invention will be described with reference to the drawings. In the description of the following drawings, the same or similar parts are denoted by the same or similar references.

(Acoustic Signal Processing Device)

An acoustic signal processing device 1 according to an embodiment of the present invention will be described with reference to see FIG. 1. The acoustic signal processing device 1 is a general computer including a processing device (not illustrated), a memory 10, and so on. The general computer implements the functions illustrated in FIG. 1 by executing an acoustic signal processing program.

Figure 2A:
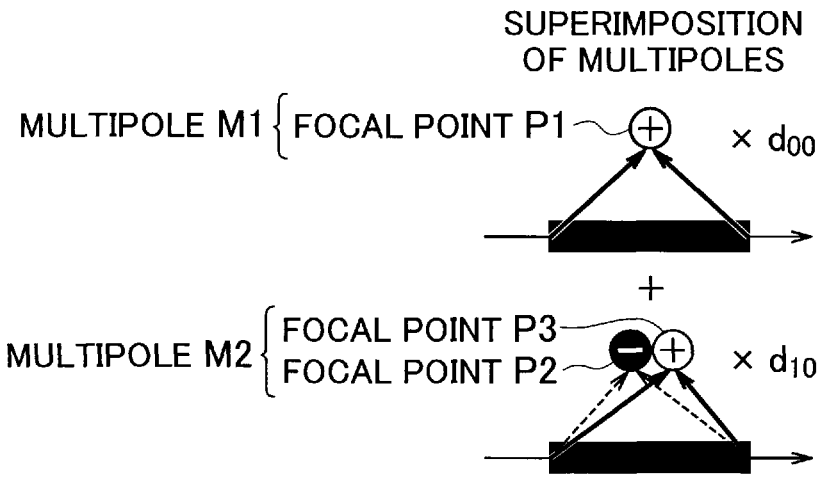
FIG. 2 is a diagram explaining the directional characteristics to be implemented by superimposing multipoles in the embodiment of the present invention.
Figure 2B:
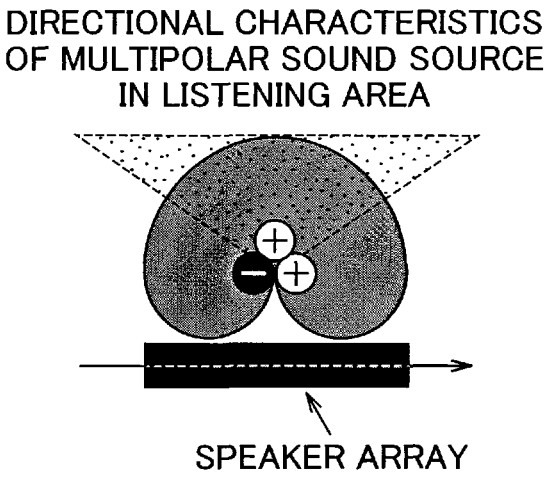

The acoustic signal processing device 1 according to the embodiment of the present invention uses a linear speaker array as illustrated in FIG. 2, including a plurality of speakers arrayed linearly, so as to weight multipoles to create a virtual sound source that protrudes forward of the speakers and has directivity. In the embodiment of the present invention, a description will be given of a case where the speakers constituting the speaker array are arrayed linearly, but the speaker array is not limited to this. The speaker array only needs to include a plurality of speakers, and the plurality of speakers do not have to be arrayed linearly.

In the embodiment of the present invention, in order to create the virtual sound source, two or more focal point sound sources with different polarities are generated at positions close to each other to create a multipole sound source. The focal point sound sources are a combination of omnidirectional point sound sources (monopole sound sources) with different polarities. In the embodiment of the present invention, a description will be given of a case where the focal point sound sources include two multipoles, and one of the multipoles is formed of a single monopole sound source while the other multipole is formed of two monopole sound sources with different polarities. However, the focal point sound sources are not limited to these.

In the embodiment of the present invention, a multipole M1 and a multipole M2 illustrated in FIG. 2(*a*) are superimposed to implement the directional characteristics illustrated in FIG. 2(*b*). The multipole M1 has a focal point P1 having positive polarity, whereas the multipole M2 has a focal point P2 having negative polarity and a focal point P3 having positive polarity. In embodiment of the present invention, the multipole M1 and the multipole M2 are weighted and superimposed to implement the directional characteristics of the multipole sound source illustrated in FIG. 2(*b*). As illustrated in FIG. 2(*b*), by superimposing multipoles having various directional characteristics, it is possible to implement desired directional characteristics in a desired range.

In order to create such a virtual sound source, the acoustic signal processing device 1 converts an input acoustic signal I into output acoustic signals O for the speakers in the linear speaker array.

Figure 1:
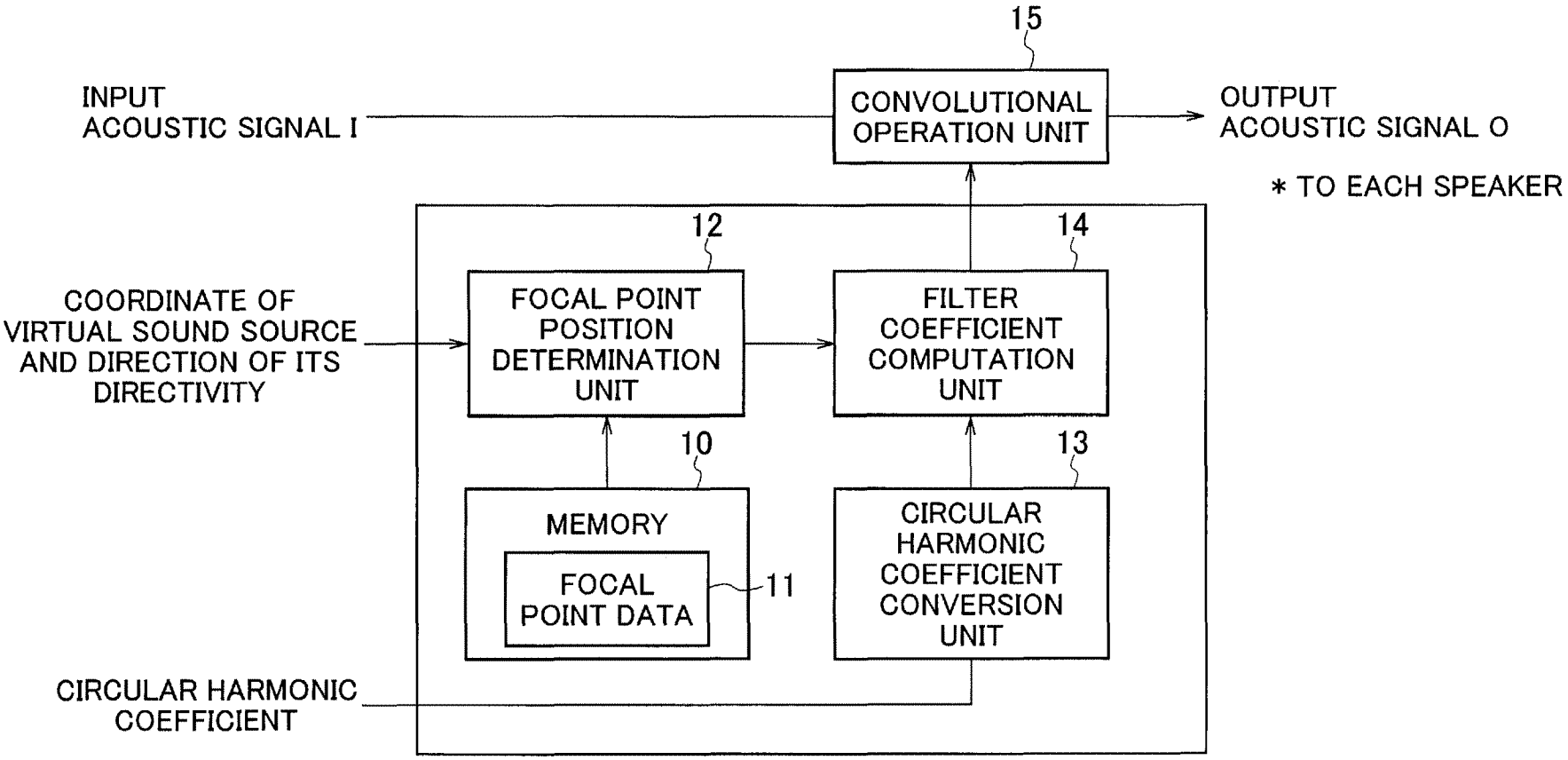
FIG. 1 is a block diagram of an acoustic signal processing device according to an embodiment of the present invention.

As illustrated in FIG. 1, the acoustic signal processing device 1 includes the memory 10, a focal point position determination unit 12, a circular harmonic coefficient conversion unit 13, a filter coefficient computation unit 14, a convolutional operation unit 15, an input-output interface (not illustrated), and so on. The input-output interface is an interface for inputting an input acoustic signal into the acoustic signal processing device 1 and outputting output acoustic signals to the speakers. The input-output interface inputs information on the coordinates of the virtual sound source and the direction of its directivity to be created by the acoustic signal processing device 1, and also circular harmonic coefficients to the acoustic signal processing device 1.

The memory 10 stores focal point data 11. In the focal point data 11, the coordinates of a plurality of focal points for creating the virtual sound source and the polarities of the focal points are associated with each other. In the embodiment of the present invention, the focal points stored in the focal point data 11 will be referred to as initial focal points, and the coordinates of the initial focal points will be referred to as initial focal point coordinates.

The focal point position determination unit 12 receives information on the position of the virtual sound source, information on the direction of its directivity, and information on target frequencies, and outputs the coordinates of a necessary number of focal points taking the directivity into account. The focal point position determination unit 12 obtains the plurality of sets of initial focal point coordinates and the coordinates and directivity of the virtual sound source. Then, for a pair of sets of initial focal point coordinates with different polarities among the plurality of sets of initial focal point coordinates, the focal point position determination unit 12 multiplies each set of initial focal point coordinates by a rotation matrix specified from the direction of the directivity based on the coordinates of the virtual sound source to thereby determine a set of focal point coordinates. The focal point position determination unit 12 multiplies the relative coordinates of each set of initial focal point coordinates relative to the coordinates of the virtual sound source by the rotation matrix, and adds the coordinates of the virtual sound source to the set of coordinates obtained by the multiplication by the rotation matrix to thereby determine a set of focal point coordinates taking the directivity into account. Note that the virtual sound source is in the center among these sets of focal point coordinates.

The focal point position determination unit 12 determines the sets of initial focal point coordinates among the plurality of sets of initial focal point coordinates that do not form a pair as sets of focal point coordinates without performing any conversion on these sets of initial focal point coordinates. In the example illustrated in FIG. 2, for the multipole M1, which has a focal point with positive polarity, the focal point position determination unit 12 outputs the set of initial focal point coordinates with positive polarity as a set of focal point coordinates. For the multipole M2, which has a focal point with positive polarity and a focal point with negative polarity, the focal point position determination unit 12 outputs sets of coordinates obtained by rotating their sets of initial focal point coordinates as sets of focal point coordinates.

The focal point position determination unit 12 obtains one or more pairs of sets of initial focal point coordinates with difference polarities from the memory 10 and also obtains the coordinates of the virtual sound source and the direction of its directivity as the characteristics to be implemented by the acoustic signal processing device 1 in response to an external input or the like. The focal point position determination unit 12 specifies a direction θ of the rotation of the sets of initial focal point coordinates from the obtained direction of the directivity.

Let a pair of sets of initial focal point coordinates be $$x_1=(\delta,0),\ \text{and}\ x_2=(-\delta,0). \qquad \text{[Math. 1]}$$

Then, if the direction θ is designated with respect to the X-axis direction, a rotation matrix G that can be specified from this direction can be figured out with equation (1). Hence, the focal point position determination unit 12 can determine the coordinates of the monopoles after rotation with equation (2).

[Math. 2]

$$G = \begin{bmatrix} \cos\theta & -\sin\theta \\ \sin\theta & \cos\theta \end{bmatrix}, \quad \text{Equation (1)}$$

$$x_i' = \begin{bmatrix} \cos\theta & -\sin\theta \\ \sin\theta & \cos\theta \end{bmatrix} \cdot x_i, \quad \text{Equation (2)}$$

For the one or more pairs of sets of initial focal point coordinates corresponding to the desired characteristics and read from the memory, the focal point position determination unit 12 multiplies each set of coordinates by the rotation matrix that can be specified from the direction of the directivity, and adds the coordinates of the virtual sound source to each set of coordinates to thereby calculate all sets of focal point coordinates.

The focal point position determination unit 12 outputs identifiers of the multipoles, the sets of focal point coordinates forming these multipoles, and the polarities of these sets of focal point coordinates in association with each other.

In the case of a multipole sound source formed of more than two monopole sound sources, such as a quadrupole sound source, the focal point position determination unit 12 calculates the additional sets of coordinates via rotation with a rotation matrix to calculate the monopole sound sources corresponding to the rotation of the directivity.

Figure 3:
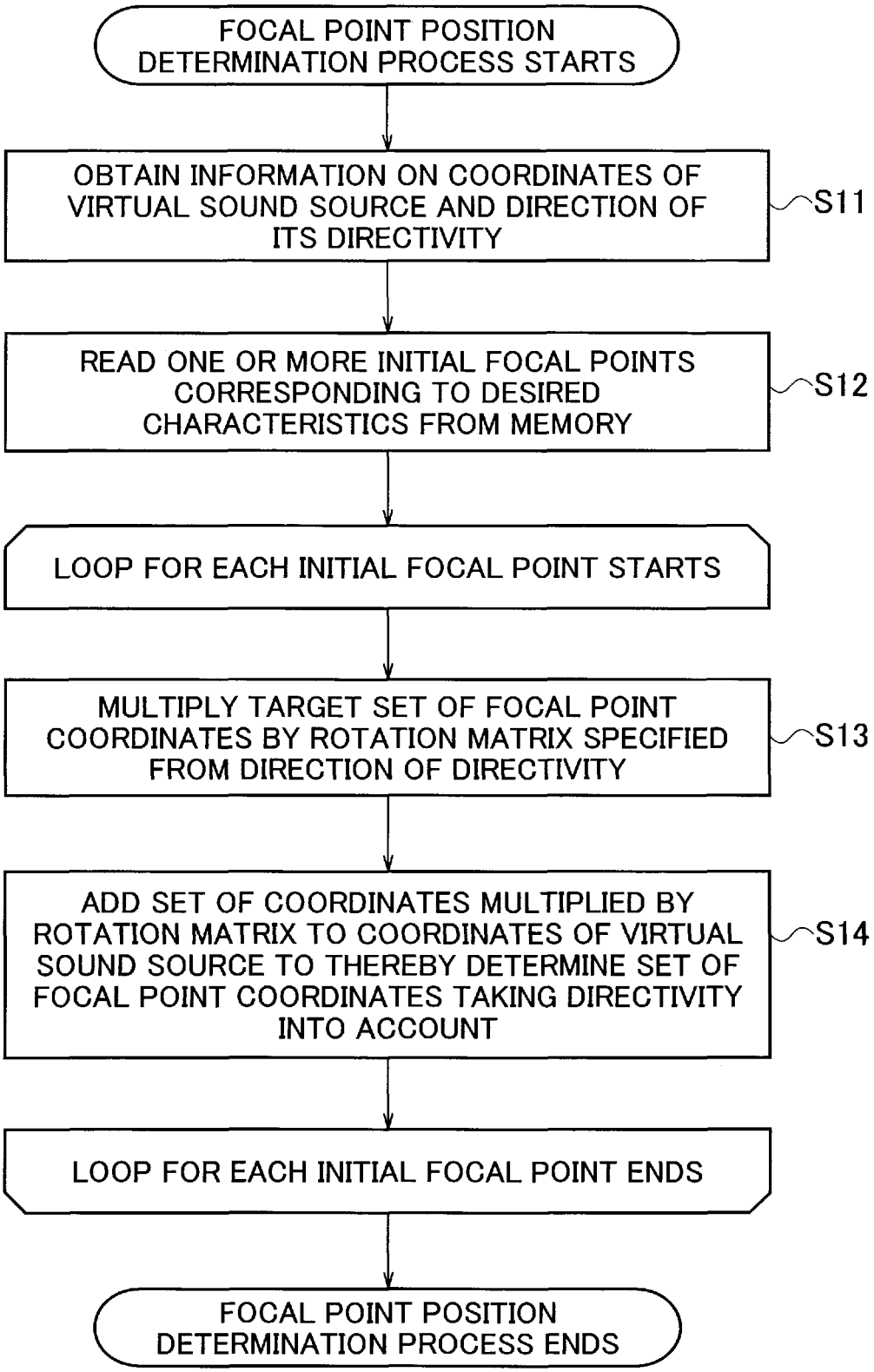
FIG. 3 is a flowchart explaining a focal point position determination process by the acoustic signal processing device according to the embodiment of the present invention.

The focal point position determination process by the focal point position determination unit 12 according to the embodiment of the present invention will be described with reference to FIG. 3. The focal point position determination unit 12 performs the process of FIG. 3 on one or more pairs of sets of initial focal point coordinates with different polarities. For the other sets of initial focal point coordinates, the focal point position determination unit 12 outputs the sets of initial focal point coordinates as sets of focal point coordinates.

First, in step S11, the focal point position determination unit 12 obtains information on the coordinates of the virtual sound source and the direction of its directivity. In step S12, the focal point position determination unit 12 reads information on one or more initial focal points corresponding to the desired characteristics from the memory.

Thereafter, the focal point position determination unit 12 iterates processes of steps S13 and S14 for each initial focal point read in step S12. In step S13, the focal point position determination unit 12 multiplies the target set of focal point coordinates to be processed by a rotation matrix specified from the direction of the directivity obtained in step S11. The target set of focal point coordinates used here is a set of relative coordinates relative to the virtual sound source. In step S14, the focal point position determination unit 12 adds the set of coordinates multiplied by the rotation matrix in step S13 to the coordinates of the virtual sound source to thereby determine a set of focal point coordinates taking the directivity into account.

The focal point position determination unit 12 terminates the process when the processes of steps S13 and S14 are finished for each initial focal point read in step S12.

Note that the processes of steps S13 and S14 only need to be performed on each focal point and may be performed in any order.

The result of a simulation of the process by the focal point position determination unit 12 will be described with reference to FIGS. 4 to 6. FIG. 4 illustrates a linear speaker array and initial focal points. The linear speaker array is arranged from (−2, 0) to (2, 0), and the pair of sets of initial focal point coordinates are (0, 1−0.0345) and (0, 1+0.0345). Here, the coordinates of the virtual sound source are (0, 1). As illustrated in FIG. 4, the acoustic field in this case is formed to be bilaterally symmetrical and therefore has no directivity.

The focal point position determination unit 12 multiplies each of these sets of initial focal point coordinates by the rotation matrix specified by equation (1). As illustrated in FIG. 5, the relative coordinates of the set of initial focal point coordinates (1, 1.0345) relative to the coordinates of the virtual sound source (0.0, 1.0) are (0.0, 0.0345). The focal point position determination unit 12 multiplies the relative coordinates of the set of initial focal point coordinates relative to the coordinates of the virtual sound source by the rotation matrix and adds the coordinates of the virtual sound source. As a result, the focal point position determination unit 12 obtains a set of rotated coordinates (0.0172, 1.0299). By processing the other set of initial focal point coordinates (0, 1−0.0345) similarly, the focal point position determination unit 12 obtains a set of rotated coordinates (−0.0172, 0.9701).

Figure 6:
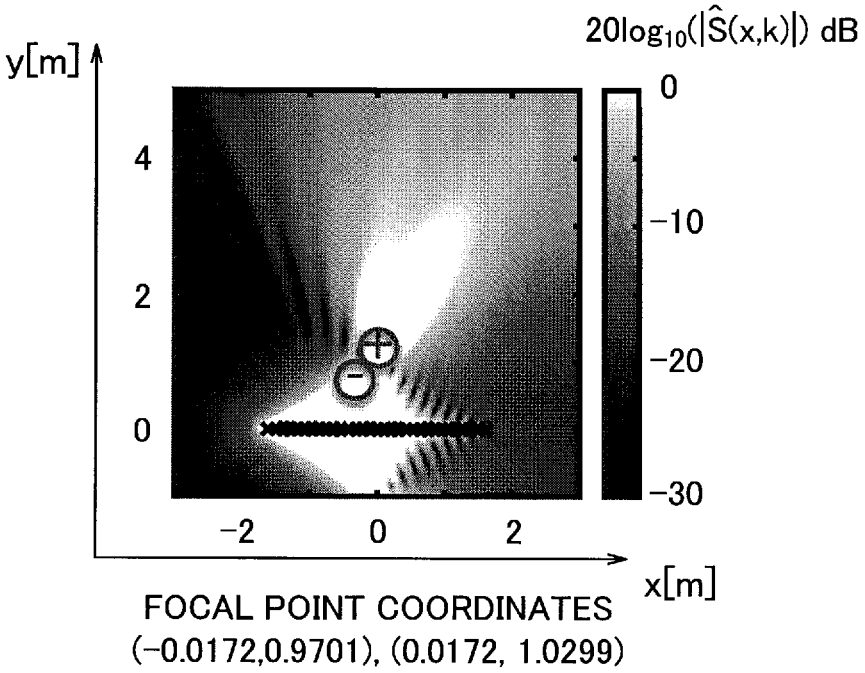
FIG. 6 is a diagram explaining sets of focal point coordinates taking directivity into account in the focal point position determination process by the acoustic signal processing device according to the embodiment of the present invention.

FIG. 6 illustrates an acoustic field with the sets of rotated coordinates obtained by the calculation in FIG. 5. Each set of monopole coordinates are rotated clockwise from that in FIG. 4 such that directivity is obtained.

After a set of focal point coordinates taking the directivity into account is calculated by the focal point position determination unit 12 for each initial focal point, the set of focal point coordinates is processed by the filter coefficient computation unit 14.

The circular harmonic coefficient conversion unit 13 calculates weights to be applied to the multipoles including the sets of focal point coordinates by using circular harmonic coefficients.

The circular harmonic coefficient conversion unit 13 analytically converts a circular harmonic series to determine the weights to be applied to the focal point sound sources, and enables creation of a virtual sound image having the directional characteristics of a sound source that exists in reality. The circular harmonic coefficient conversion unit 13 calculates the weights to be applied to the multipoles including the sets of focal point coordinates outputted by the focal point position determination unit 12.

The circular harmonic coefficient conversion unit 13 calculates the weights to be applied to the multipoles with equation (3).

[Math. 3]

$$d_{m,n} = \frac{\partial^{m+n} S(0)}{\partial x^m \partial y^n} = j^n \cdot (m+n)! \cdot \left\{ \check{S}^{(2)}(m+n) \cdot H_{m+n}^{(2)} + (-1)^n \cdot \check{S}^{(2)}(-m-n) \cdot H_{-m-n}^{(2)} \right\} \quad \text{Equation (3)}$$

$d_{m,n}$: The weight to be applied to a multipole $p_{m,n}$ m,n: The orders of partial differentiations of the acoustic field in the x-axis direction and the y-axis direction $\check{S}^{(2)}(m+n)$: The circular harmonic coefficient $H_{m,n}^{(2)}(k)$: The Hankel function of the second kind of (m+n)-th order k: a wavenumber (k=ω/c)

In equation (3), m and n are the orders of partial differentiations of the acoustic field in the x-axis direction and the y-axis direction, respectively. Since combinations of m and n do not overlap, they may be used as mere indexes.

The circular harmonic coefficient conversion unit 13 obtains each circular harmonic coefficient as appropriate. For example, the circular harmonic coefficient may be received from an external program, or the circular harmonic coefficient may be obtained via observation with a plurality of microphones disposed in a circle centered on the sound source whose directivity is to be measured. Also, the circular harmonic coefficient may be stored beforehand in a separately provided memory and read out when necessary by the circular harmonic coefficient conversion unit 13.

Here, the derivation of equation (3) for outputting the weight for each multipole from the circular harmonic coefficient will be described. First, a sound source having any directivity is assumed to be present at the origin in the xy plane, and the acoustic field generated by this sound source is S(x). When this acoustic field is Taylor-expanded at the origin, the acoustic field at a point x=(cos α, sin α) in a unit circle is given as the following equation.

[Math. 4]

$$S(x) = \sum_{m+n=1}^{\infty} \sum_{m=0}^{m+n} \frac{\partial^{m+n} S(0)}{\partial x^m \partial y^n} \cdot \frac{\cos^m \alpha \cdot \sin^n \alpha}{m! \cdot n!} \qquad \text{Equation (4)}$$

S(x): The acoustic field generated by the sound source having any directivity at the origin in the xy plane x: A point in a unit circle and x=(cos α,sin α)

Meanwhile, any acoustic field can be expressed by equation (5) via circular harmonic expansion.

[Math. 5]

$$S(x,\omega)=\Sigma_{v=-\infty}^{\infty} \check{S}^{(2)}(v,\omega) H_v^{(2)}(kr) e^{jv\alpha}, \qquad \text{Equation (5)}$$

$e^{jv\alpha}$: Complex sinusoidal wave v: Order

ω: Angular frequency

Euler's formula is applied for the complex sinusoidal wave, and then binomial expansion is performed for v to perform transformation as the following equation.

[Math. 6]

$$S(x) = \check{S}^{(2)}(0) \cdot H_0^{(2)}(k) + \sum_{m+n=1}^{\infty} \sum_{m=0}^{v} j^n \cdot \binom{m+n}{m} \cdot \check{S}^{(2)}(m+n) \cdot H_{m+n}^{(2)} \cdot \cos^m \alpha \cdot \sin^n \alpha + \sum_{m+n=1}^{\infty} \sum_{m=0}^{v} (-j)^n \cdot \binom{m+n}{m} \cdot \check{S}^{(2)}(m+n) \cdot H_{-m-n}^{(2)} \cdot \cos^m \alpha \cdot \sin^n \alpha. \qquad \text{Equation (6)}$$

Further, the coefficients in equations (4) and (6) are compared. As a result, a weight coefficient can be calculated as in equation (3).

Figure 7:
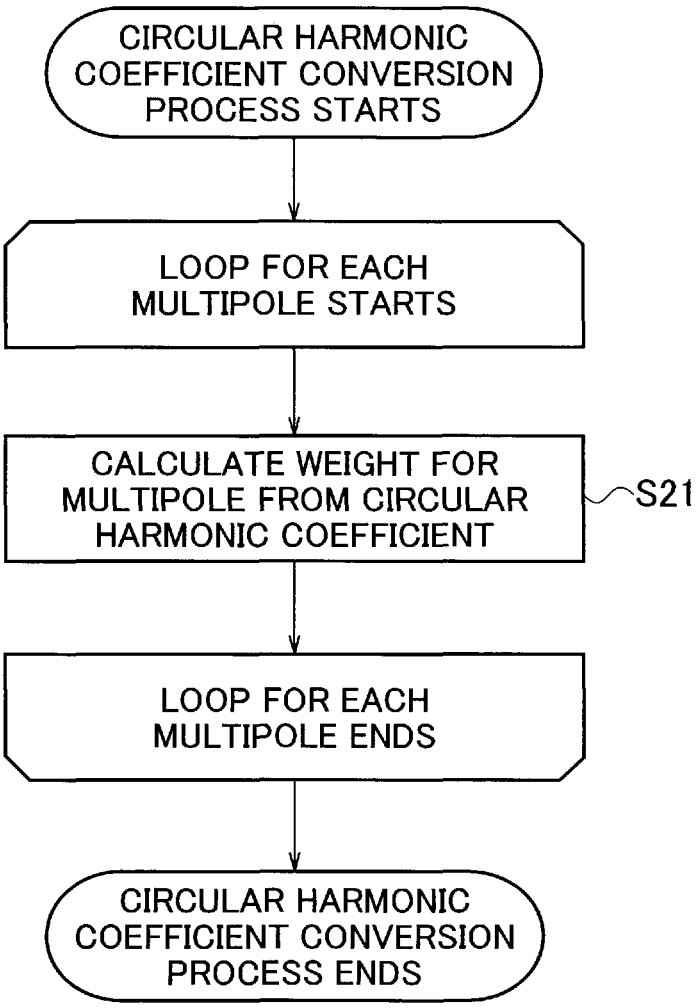
FIG. 7 is a flowchart explaining a circular harmonic coefficient conversion process by the acoustic signal processing device according to the embodiment of the present invention.

The circular harmonic coefficient conversion process by the circular harmonic coefficient conversion unit 13 will be described with reference to FIG. 7.

The circular harmonic coefficient conversion unit 13 performs a process of step S21 for each multipole outputted by the focal point position determination unit 12. In step S21, the circular harmonic coefficient conversion unit 13 calculates the weight for the multipole from the circular harmonic coefficient in accordance with equation (3).

For each speaker in the speaker array, the filter coefficient computation unit 14 computes a weighted driving function to be applied to the speaker from the sets of focal point coordinates, the polarities of the sets of focal point coordinates, and the weights to be applied to the multipoles. For each speaker in the linear speaker array, the filter coefficient computation unit 14 calculates a weighted driving function to be convolved into the input acoustic signal I from each set of focal point coordinates determined by the focal point position determination unit 12. The filter coefficient computation unit 14 calculates driving functions by respectively using the sets of focal point coordinates and computes a weighted driving function to be applied to the speaker from composite driving functions calculated respectively for the multipoles and the weights to be applied to the multipoles, the composite driving functions being calculated from the polarities of the sets of focal point coordinates forming the multipoles and the driving functions. Here, the filter coefficient computation unit 14 calculates each of the composite driving functions for the multipoles by adding together functions which are obtained respectively for the sets of focal point coordinates included in the multipole and in each of which the polarity of the set of focal point coordinates and the corresponding driving function are multiplied. Also, the filter coefficient computation unit 14 calculates the weighted driving function by multiplying the composite driving functions calculated for the multipoles by the weights to be applied to the multipoles and adding the multiplied composite driving functions together.

Firstly, when calculating a weighted driving function for a predetermined speaker, the filter coefficient computation unit 14 calculates a driving function for each focal point with equation (7).

[Math. 7]

$$D_{2.5D}(x_i, x_s) = -\frac{jk}{2} g_0 \frac{y_i - y_s}{|x_i - x_s|} H_1^{(1)}(k|x_i - x_s|), \qquad \text{Equation (7)}$$

The position of the virtual sound source: $x_s=(x_s,y_s)$

The position of the i-th speaker: $x_i=(x_i,y_i)$ k: The wavenumber (k=ω/c)

c: The speed of sound

ω: Each frequency (ω=2πf)

f: Frequency $j=\sqrt{-1}$, $H_1^{(1)}$: The Hankel function of the first kind of first order Then, the filter coefficient computation unit 14 calculates a composite driving function for a predetermined multipole with equation (8) from the polarity of the focal point sound source belonging to this multipole and the driving function for each focal point calculated with equation (7).

[Math. 8]

$$D_{m,n}(x_0)=\Sigma_{i=0}^{N-1} g_s^{(i)} \cdot D(x_0, x_s^{(1)}), \qquad \text{Equation (8))}$$

$x_s^{(i)} \in X_{m,n}$: The coordinates of a focal point included in the multipole $p_{m,n}$ $g_s^{(i)} \in G_{m,n}$: The polarity of the focal point $x_s^{(i)}$ N: The number of focal points included in the multipole $p_{m,n}$ For each multipole, the filter coefficient computation unit 14 applies the weight calculated by the circular harmonic coefficient conversion unit 13 to the composite driving function calculated with equation (8), and calculates a weighted driving function with equation (9).

[Math. 9]

$$D(x_0)=\Sigma_{m,n}d_{m,n}\cdot D_{m,n}(x_D), \quad \text{Equation (9)}$$

Figure 8:
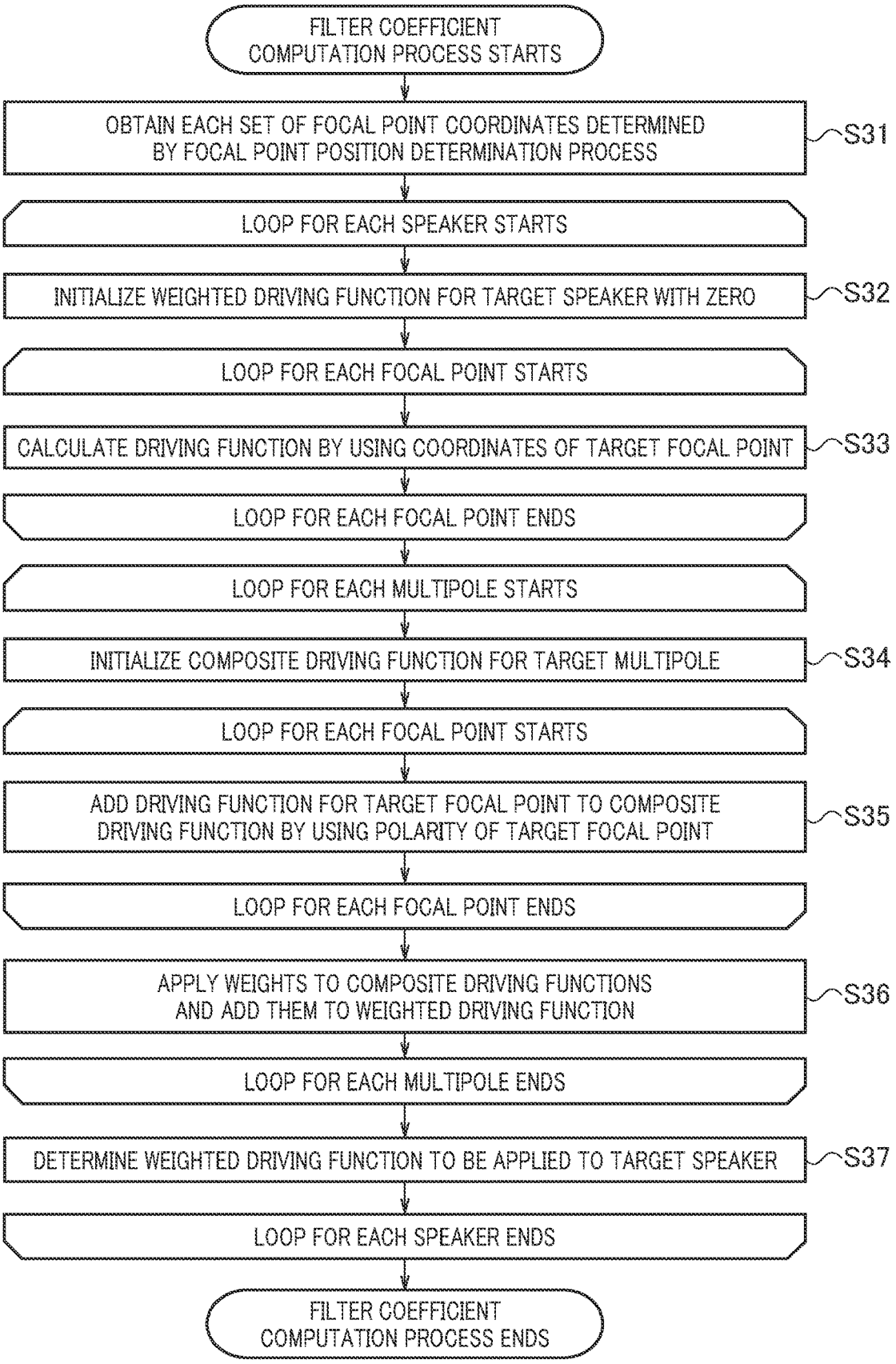
FIG. 8 is a flowchart explaining a filter coefficient computation process by the acoustic signal processing device according to the embodiment of the present invention.
Figure 9:
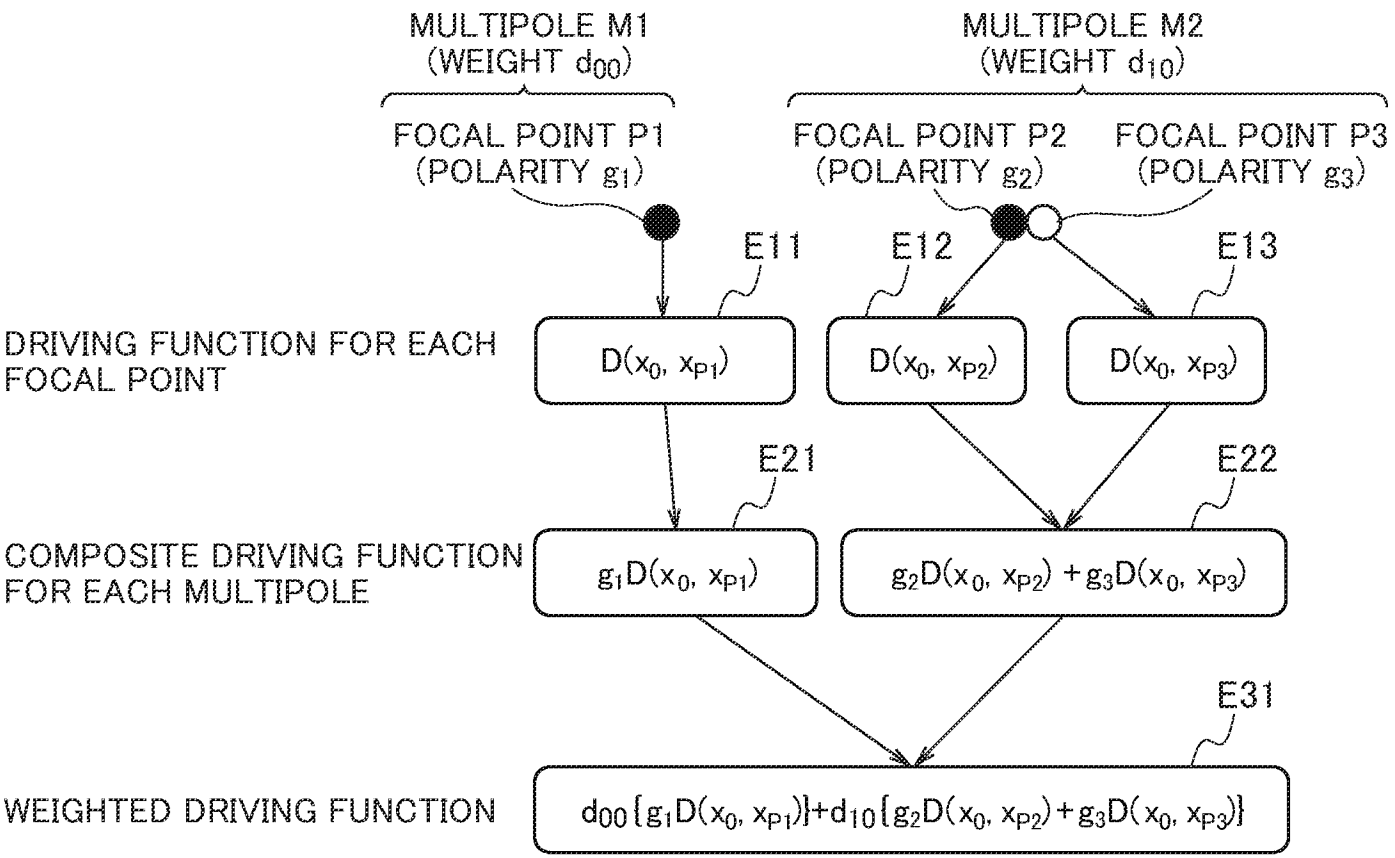
FIG. 9 is a diagram explaining an example of functions calculated in the filter coefficient computation process by the acoustic signal processing device according to the embodiment of the present invention.

Next, the filter coefficient computation process by the filter coefficient computation unit 14 will be described with reference to FIG. 8. Here, the calculation equations in the case where the multipoles and the focal points illustrated in FIG. 2 are given will be described with reference to FIG. 9.

First, in step S31, the filter coefficient computation unit 14 obtains each set of focal point coordinates determined in the focal point position determination process. In doing so, the filter coefficient computation unit 14 additionally obtains the polarities of the focal points and the relationship between the sets of focal point coordinates forming the multipoles.

The filter coefficient computation unit 14 iterates processes of steps S32 to S37 to calculate a weighted driving function for each speaker. In step S32, the filter coefficient computation unit 14 initializes the weighted driving function for the target speaker with zero.

The filter coefficient computation unit 14 iterates the process of step S33 for each focal point. In step S33, the filter coefficient computation unit 14 calculates a driving function by using the coordinates of the target focal point. In the example illustrated in FIG. 9, the filter coefficient computation unit 14 calculates equations E11 to E13 as the driving functions for the focal points.

The filter coefficient computation unit 14 iterates the processes of steps S34 to S36 for each multipole to thereby calculate a composite driving function for each multipole. In step S34, the filter coefficient computation unit 14 initializes the composite driving function for the processing target multipole.

The filter coefficient computation unit 14 performs the process of step S35 for each focal point included in the processing target multipole. In step S35, using the polarity of the target focal point, the filter coefficient computation unit 14 adds the drive function for the target focal point calculated in step S33 to the composite drive function. In the example illustrated in FIG. 9, the filter coefficient computation unit 14 calculates an equation E21 for the multipole M1 and calculates an equation E22 for the multipole M2.

In step S36, the filter coefficient computation unit 14 applies the weights calculated by the circular harmonic coefficient conversion unit 13 to the composite driving functions calculated in step S35 to calculate a weighted driving function. In the example illustrated in FIG. 9, the filter coefficient computation unit 14 adds together a function obtained by applying the weight for the multipole M1 to the equation E21 calculated for the multipole M1 and a function obtained by applying the weight for the multipole M2 to the equation E22 calculated for the multipole M2 to thereby calculate a weighted driving function being an equation E31.

In step S37, the filter coefficient computation unit 14 outputs the weighted driving function obtained after the calculation for each multipole as a weighted driving function to be applied to the target speaker.

After the filter coefficient computation unit 14 calculates a weighted driving function for each speaker in the linear speaker array, the convolutional operation unit 15 convolves the weighted driving function into the input acoustic signal I to thereby calculate the output acoustic signal O to be applied to the speaker.

For each speaker in the linear speaker array, the convolutional operation unit 15 convolves the weighted driving function for the speaker into the input acoustic signal I to output the output acoustic signal O for the speaker. For a predetermined speaker, the convolutional operation unit 15 obtains the output acoustic signal O for this speaker by convolving the weighted driving function for this speaker into the input acoustic signal I. The convolutional operation unit 15 iterates similar processes for each speaker to obtain the output acoustic signal O for the speaker.

Figure 10:
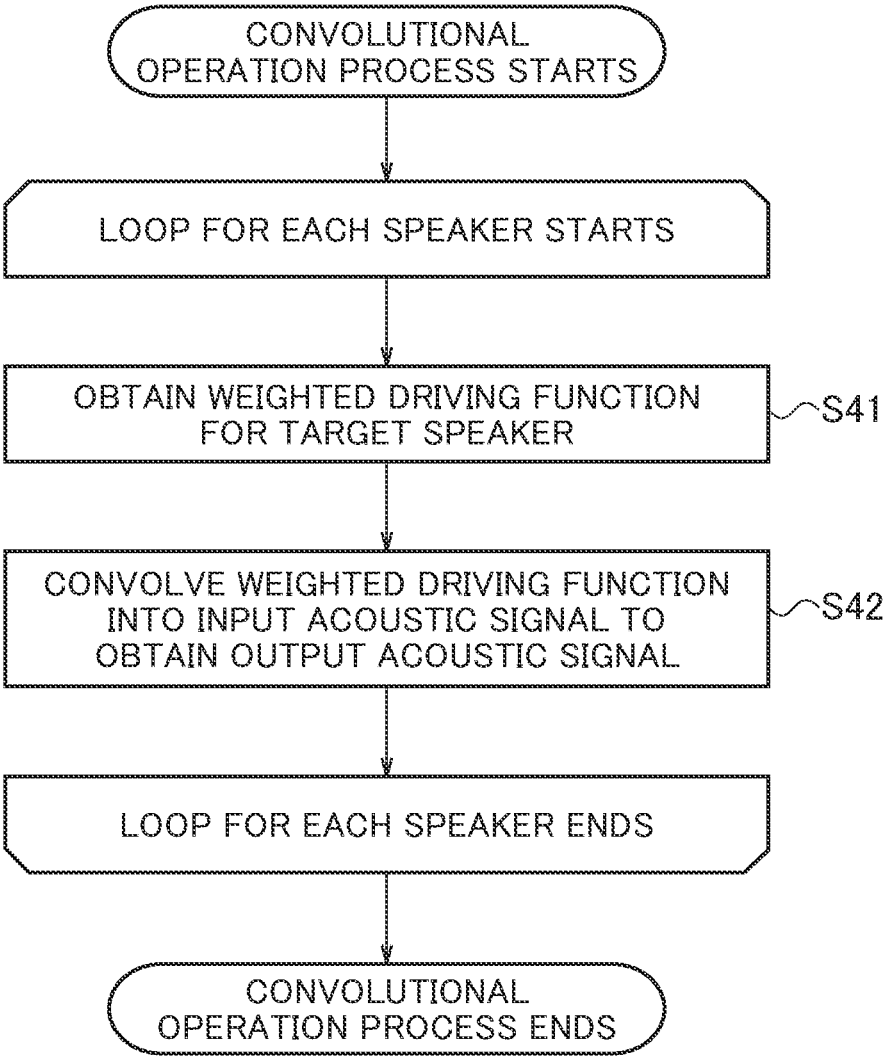
FIG. 10 is a flowchart explaining a convolutional computation process by the acoustic signal processing device according to the embodiment of the present invention.

The convolutional computation process by the convolutional operation unit 15 will be described with reference to FIG. 10.

The convolutional operation unit 15 iterates processes of steps S41 and S42 for each speaker in the linear speaker array. In step S41, the convolutional operation unit 15 obtains the weighted drive function for the target speaker to be processed from the filter coefficient computation unit 14. In step S42, the convolutional operation unit 15 convolves the weighted drive function obtained in step S41 into the input acoustic signal I to obtain the output acoustic signal O.

The convolutional operation unit 15 terminates the process when the processes of steps S41 and S42 are finished for each speaker. Note that the processes of steps S41 and S42 only need to be performed on each speaker and may be performed in any order.

The acoustic signal processing device 1 according to the embodiment of the present invention rotates sets of initial focal point coordinates to calculate sets of focal point coordinates for implementing desired directivity in advance and, for these sets of focal point coordinates, calculates a weighted driving function corresponding to each speaker. The acoustic signal processing device 1 convolves the weighted driving function corresponding to each speaker into the input acoustic signal I to thereby obtain the output acoustic signal O for the speaker. This weighted driving function is given weights converted from circular harmonic coefficients for respective multipoles. Thus, by setting each circular harmonic coefficient as appropriate, the output acoustic signal O for each speaker can be adjusted as desired. As described above, the acoustic signal processing device 1 according to the embodiment of the present invention is capable of modeling the directivity of a sound source such as a musical instrument and implementing any directional characteristics by superimposing multipoles.

OTHER EMBODIMENTS

As described above, a description has been by using the embodiment of the present invention. However, it should not be understood that the description and drawings which constitute part of this disclosure limit the invention. From this disclosure, various alternative embodiments, examples, and operation techniques will be easily found by those skilled in the art.

The present invention naturally includes various embodiments which are not described herein. Accordingly, the technical scope of the present invention should be determined only by the matters to define the invention in the scope of claims regarded as appropriate based on the description.

EXPLANATION OF THE REFERENCE NUMERALS

1 acoustic signal processing device
10 memory
11 focal point data
12 focal point position determination unit
13 circular harmonic coefficient conversion unit
14 filter coefficient computation unit

15 convolutional operation unit

I input acoustic signal

O output acoustic signal

The invention claimed is:

1. An acoustic signal processing device for converting an input acoustic signal into output acoustic signals for a plurality of speakers in a speaker array formed by arranging the speakers for creating a virtual sound source, comprising:

a focal point position determination unit that obtains a plurality of sets of initial focal point coordinates, coordinates of the virtual sound source, and a direction of directivity thereof, and for a pair of sets of initial focal point coordinates with different polarities among the plurality of sets of initial focal point coordinates, multiplies the sets of initial focal point coordinates by a rotation matrix based on the coordinates of the virtual sound source to thereby determine sets of focal point coordinates, the rotation matrix being specified from the direction of the directivity;

a circular harmonic coefficient conversion unit that calculates weights to be applied to multipoles including the sets of focal point coordinates from a circular harmonic coefficient;

a filter coefficient computation unit that, for each of the speakers in the speaker array, computes a weighted driving function to be applied to the speaker from the sets of focal point coordinates, polarities of the sets of focal point coordinates, and the weights to be applied to the multipoles; and a convolutional operation unit that, for each of the speakers in the speaker array, convolves the weighted driving function for the speaker into the input acoustic signal to output the output acoustic signal for the speaker.

2. The acoustic signal processing device according to claim 1, wherein the circular harmonic coefficient conversion unit calculates the weight to be applied to the multipole with equation (1)

[Math. 1]

$$d_{m,n} = \frac{\partial^{m+n} S(0)}{\partial x^m \partial y^n} = j^n \cdot (m+n)! \cdot \left\{ \check{S}^{(2)}(m+n) \cdot H^{(2)}_{m+n} + (-1)^n \cdot \check{S}^{(2)}(-m-n) \cdot H^{(2)}_{-m-n} \right\} \quad \text{Equation (1)}$$

$d_{m,n}$: the weight to be applied to a multipole $p_{m,n}$, m,n: the orders of partial differentiations of the acoustic field in the x-axis direction and the y-axis direction $\check{S}^{(2)}(m+n)$: The circular harmonic coefficient $H_{m,n}^{(2)}(k)$: The Hankel function of the second kind of (m+n)-th order k: a wavenumber ($k=\omega/c$).

3. The acoustic signal processing device according to claim 1, wherein the filter coefficient computation unit calculates driving functions by respectively using the sets of focal point coordinates and computes the weighted driving function to be applied to the speaker from composite driving functions calculated respectively for the multipoles and the weights to be applied to the multipoles, the composite driving functions being calculated from the polarities of the sets of focal point coordinates forming the multipoles and the driving functions.

4. The acoustic signal processing device according to claim 3, wherein the filter coefficient computation unit calculates each of the composite driving functions for the multipoles by adding together functions which are obtained respectively for the sets of focal point coordinates included in the multipole and in each of which the polarity of the set of focal point coordinates and the corresponding driving function are multiplied.

5. The acoustic signal processing device according to claim 3, wherein the filter coefficient computation unit calculates the weighted driving function by multiplying the composite driving functions calculated for the multipoles by the weights to be applied to the multipoles and adding the multiplied composite driving functions together.

6. An acoustic signal processing method for converting an input acoustic signal into output acoustic signals for a plurality of speakers in a speaker array formed by arranging the speakers for creating a virtual sound source, comprising:

obtaining a plurality of sets of initial focal point coordinates, coordinates of the virtual sound source, and a direction of directivity thereof;

for a pair of sets of initial focal point coordinates with different polarities among the plurality of sets of initial focal point coordinates among the plurality of sets of initial focal point coordinates, multiplying the sets of initial focal point coordinates by a rotation matrix based on the coordinates of the virtual sound source to thereby determine sets of focal point coordinates, the rotation matrix being specified from the direction of the directivity;

calculating weights to be applied to multipoles including the sets of focal point coordinates from a circular harmonic coefficient;

for each of the speakers in the speaker array, computing a weighted driving function to be applied to the speaker from the sets of focal point coordinates, polarities of the sets of focal point coordinates, and the weights to be applied to the multipoles; and for each of the speakers in the speaker array, convolving the weighted driving function for the speaker into the input acoustic signal to output the output acoustic signal for the speaker.

7. A non-transitory computer readable medium having stored thereon an acoustic signal processing program that causes a computer to perform operations comprising:

obtaining a plurality of sets of initial focal point coordinates, coordinates of the virtual sound source, and a direction of directivity thereof, and for a pair of sets of initial focal point coordinates with different polarities among the plurality of sets of initial focal point coordinates, multiplies the sets of initial focal point coordinates by a rotation matrix based on the coordinates of the virtual sound source to thereby determine sets of focal point coordinates, the rotation matrix being specified from the direction of the directivity;

calculating weights to be applied to multipoles including the sets of focal point coordinates from a circular harmonic coefficient;

for each of speakers in a speaker array, computing a weighted driving function to be applied to the speaker from the sets of focal point coordinates, polarities of the sets of focal point coordinates, and the weights to be applied to the multipoles; and for each of the speakers in the speaker array, convolving the weighted driving function for the speaker into the input acoustic signal to output the output acoustic signal for the speaker.

8. The non-transitory computer readable medium according to claim 7, wherein calculating weights to be applied to multipoles comprises:

calculating the weight to be applied to the multipole with equation (1)

[Math. 1]

$$d_{m,n} = \frac{\partial^{m+n} S(0)}{\partial x^m \partial y^n} = j^n \cdot (m+n)! \cdot \left\{ \check{S}^{(2)}(m+n) \cdot H^{(2)}_{m+n} + (-1)^n \cdot \check{S}^{(2)}(-m-n) \cdot H^{(2)}_{-m-n} \right\} \quad \text{Equation (1)}$$

$d_{m,n}$: The weight to be applied to a multipole $p_{m,n}$, m,n: The orders of partial differentiations of the acoustic field in the x-axis direction and the y-axis direction $\check{S}^{(2)}(m+n)$: The circular harmonic coefficient $H_{m,n}^{(2)}(k)$: The Hankel function of the second kind of (m+n)-th order k: a wavenumber (k=ω/c).

9. The non-transitory computer readable medium according to claim 7, wherein the operations further comprise calculating driving functions by respectively using the sets of focal point coordinates and computing the weighted driving function to be applied to the speaker from composite driving functions calculated respectively for the multipoles and the weights to be applied to the multipoles, the composite driving functions being calculated from the polarities of the sets of focal point coordinates forming the multipoles and the driving functions.

10. The non-transitory computer readable medium according to claim 9, wherein the operations further comprise calculating each of the composite driving functions for the multipoles by adding together functions which are obtained respectively for the sets of focal point coordinates included in the multipole and in each of which the polarity of the set of focal point coordinates and the corresponding driving function are multiplied.

11. The non-transitory computer readable medium according to claim 9, wherein the operations further comprise calculating the weighted driving function by multiplying the composite driving functions calculated for the multipoles by the weights to be applied to the multipoles and adding the multiplied composite driving functions together.

* * * * *